US007017461B2

(12) United States Patent
Estes

(10) Patent No.: US 7,017,461 B2
(45) Date of Patent: Mar. 28, 2006

(54) DUAL POSITION AUTOMATIC NOTCHER

(75) Inventor: Stephen R. Estes, South Bend, IN (US)

(73) Assignee: SSD Control Technology Inc., South Bend, IN (US)

( * ) Notice: Subject to any disclaimer, the term of this patent is extended or adjusted under 35 U.S.C. 154(b) by 0 days.

(21) Appl. No.: 10/292,685

(22) Filed: Nov. 12, 2002

(65) Prior Publication Data

US 2004/0089121 A1 May 13, 2004

(51) Int. Cl.
*B26B 1/00* (2006.01)

(52) U.S. Cl. ..... 83/13; 83/684; 83/687; 83/669; 83/671

(58) Field of Classification Search ..... 83/34, 83/916, 917, 618, 620, 621, 622, 699, 52, 83/54, 191, 188, 53, 553, 679–696, 13, 671, 83/669; 72/326, 325, 404, 471; 113/116; 29/283.5, 432, 523, 157.4; 285/222, 382.4
See application file for complete search history.

(56) References Cited

U.S. PATENT DOCUMENTS

| | | | | | |
|---|---|---|---|---|---|
| 1,679,572 | A | | 8/1928 | Hayden | |
| 1,895,589 | A | | 1/1933 | Spatta | |
| 3,270,604 | A | | 9/1966 | Waltonen | |
| 3,827,116 | A | * | 8/1974 | Carroll | 29/38 C |
| 3,938,413 | A | * | 2/1976 | Goettel et al. | 83/145 |
| 3,986,470 | A | * | 10/1976 | Berry et al. | 72/326 |
| 4,054,073 | A | * | 10/1977 | Smith et al. | 83/599 |
| 4,072,076 | A | * | 2/1978 | Miles | 83/300 |
| 4,205,545 | A | | 6/1980 | Andrews | |
| 4,307,499 | A | * | 12/1981 | Isella | 29/33.2 |
| 4,334,703 | A | | 6/1982 | Arthur et al. | |
| 4,519,135 | A | * | 5/1985 | LaBounty | 30/134 |
| 4,621,553 | A | | 11/1986 | Gruchalski et al. | |
| 4,633,744 | A | * | 1/1987 | Maurer | 83/128 |
| 5,048,385 | A | * | 9/1991 | Eckert et al. | 83/34 |
| 5,069,575 | A | * | 12/1991 | Anderson | 441/6 |
| 5,088,193 | A | * | 2/1992 | Okada et al. | 29/890.043 |
| 5,119,666 | A | * | 6/1992 | Fujiwara | 72/442 |
| 5,211,095 | A | * | 5/1993 | Chun et al. | 83/552 |
| 5,421,086 | A | * | 6/1995 | Le Gauyer | 29/890.053 |
| 5,517,744 | A | * | 5/1996 | Moser et al. | 29/525 |
| 5,689,986 | A | * | 11/1997 | Jacobs, Jr. | 72/7.4 |
| 5,787,775 | A | * | 8/1998 | Stevens et al. | 83/34 |
| 5,899,131 | A | * | 5/1999 | Benkert et al. | 83/188 |
| 6,148,707 | A | * | 11/2000 | Kouno | 83/552 |
| 6,189,361 | B1 | * | 2/2001 | Seki et al. | 72/325 |

(Continued)

FOREIGN PATENT DOCUMENTS

| | | |
|---|---|---|
| CA | 947194 | 5/1974 |

(Continued)

*Primary Examiner*—Allan N. Shoap
*Assistant Examiner*—Ghassem Alie
(74) *Attorney, Agent, or Firm*—Marshall, Gerstein & Borun LLP

(57) ABSTRACT

A device for consecutively forming one or more notches in a first surface and one or more notches in second surface of a hollow workpiece. The notching device including a first die and a second die that is fixed relative to the first die; and a shiftable punch having opposing first and second cutting surfaces. The punch shiftable between a first punching position and a second punching position and aligned such that the first cutting surface and the first die cooperating to form a first notch when the punch proceeds towards the first position, and the second cutting surface and the second die cooperating to form a second notch when the punch proceeds towards a second position.

25 Claims, 9 Drawing Sheets

U.S. PATENT DOCUMENTS

| | | | | |
|---|---|---|---|---|
| 6,439,089 | B1 * | 8/2002 | Fasske | 83/13 |
| 6,502,447 | B1 * | 1/2003 | Adams et al. | 72/326 |
| 6,640,602 | B1 | 11/2003 | Estes | |

FOREIGN PATENT DOCUMENTS

| | | | |
|---|---|---|---|
| SU | 919788 | B | 4/1982 |

* cited by examiner

DUAL POSITION AUTOMATIC NOTCHER

TECHNICAL FIELD

The technology generally relates to notching equipment, and more specifically to a device that is capable of consecutively forming notches in a hollow workpiece.

BACKGROUND

Polyvinyl tubing is commonly used for a variety of products such as fencing, decking and lawn furniture. In these and other similar applications it is often required to process the tubing through multiple manufacturing steps to produce a single complete part. For example, in many applications notches must be formed into two or more of the tube sidewalls in order to permit an end portion of one piece of tubing to be inserted and locked within a cooperating aperture of another piece. In one exemplary application, the notched end of one tubular polyvinyl fence rail is inserted into a receiving aperture in a tubular polyvinyl fence post, thereby forming an easy to assemble joint.

The processing of such components often requires the polyvinyl tubing to go through several repetitions in a single position notching die to create a complete section of tubing. In such a process, the workpiece (e.g. a piece of hollow polyvinyl tubing or some other tubing material) is aligned and inserted into the notching die. The die is cycled to create a notch on a first surface, and then the workpiece is removed from the die and reoriented. The reoriented workpiece is again inserted into the die to create another notch on a second surface. This process is repeated until the desired number and location of notches is achieved.

In order to improve processing efficiencies, it may be desirable to create multiple notches without having to remove and reorient the workpiece.

DETAILED DESCRIPTION

The following detailed description is not intended to limit the scope of the device to the precise form or forms detailed herein. Instead, the following description is intended to be illustrative of the principles disclosed herein so that others may follow the teachings.

Figure 1:
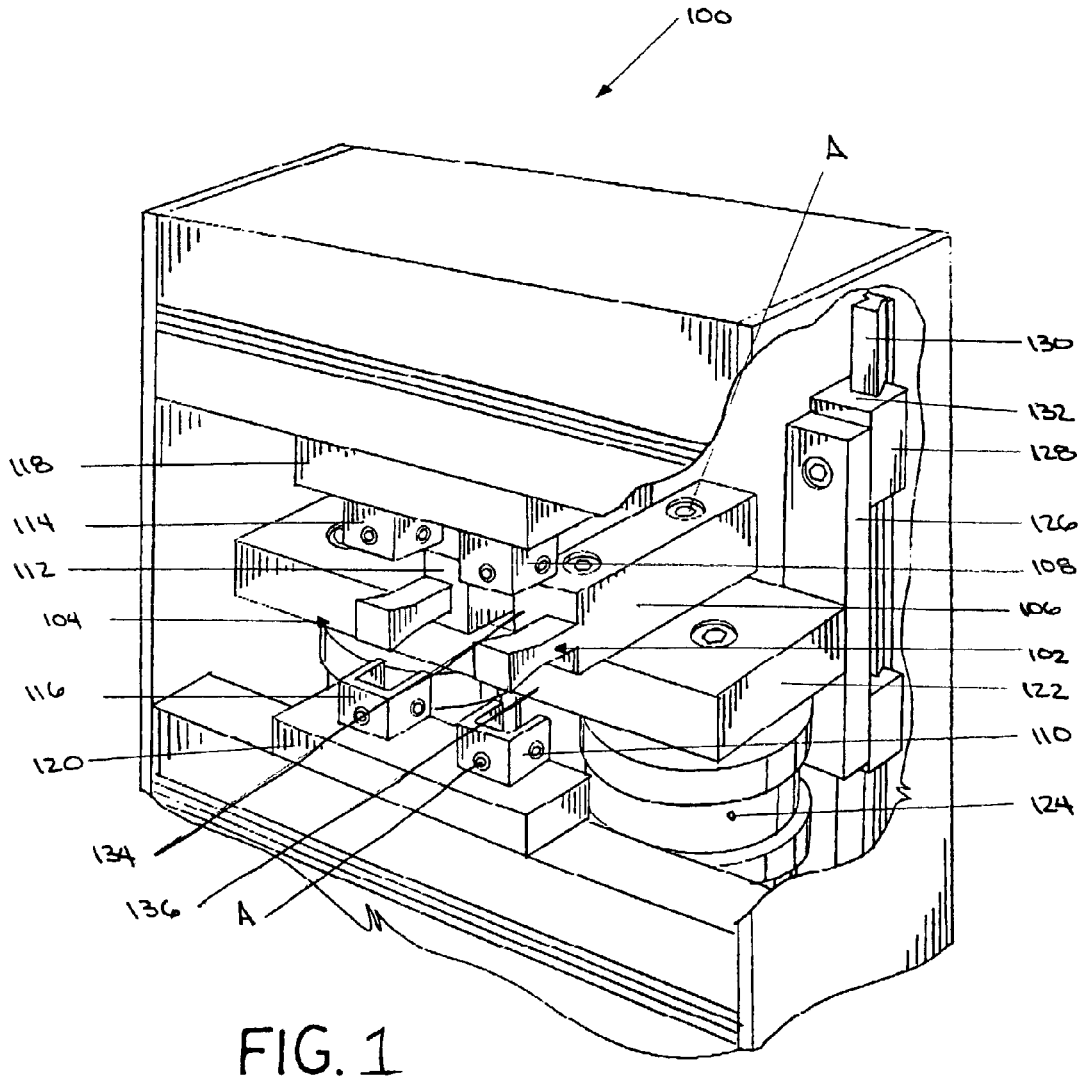
FIG. 1 is perspective view of a device for notching a hollow workpiece.

FIG. 1 illustrates a notching device generally indicated by the numeral 100. The notching device 100 includes a pair of two-position die sets 102 and 104. The first die set 102 includes a punch block 106, a top die 108, and a bottom die 110. The second die set 104 includes a punch block 112, a top die 114, and a bottom die 116. Preferably both the first die set 102 and the second die set 104 are manufactured from a tool steel, such as S-7, A-2, O-6, CPM, or any other applicable series of steel, all of which are commonly employed in the art. Moreover, it will be understood that the notching device disclosed herein is described as having a vertical orientation, only for the sake of convenience, and not because it impacts the operation or effectiveness of the device in any way. The notching device further includes a fixed top support block 118, a fixed bottom support block 120 and a shiftable support block 122 disposed therebetween. The shiftable support block 122 is fixedly mounted to at least one actuator 124 and to a coupling block 126. The coupling block 126, in turn, is fixedly attached to at least one linear bearing slide 128.

The actuator 124 may be a commercially available PARKER® hydraulic cylinder or a BIMBA® pneumatic cylinder, both of which are configured to have three operating positions, top, at-rest (neutral), and bottom, and are sized to generate sufficient force to notch the workpiece. The linear bearing slide 128 may be, for example, a THK® SR-85T LM guide or a THOMSON® continuously supported single (1CA) RoundRail® linear guide or any other suitable bearing system. Typical linear bearing slides include a ground shaft or contoured rail 130 and at least one slider 132. The slider 132 is designed to engage the rail 130 with a plurality of roller elements (not shown) such as ball, cylindrical or tapered bearings, to provide smooth continuous motion between two points. The actuator 124 and linear bearing slide 128 cooperate to shift and precisely guide the shiftable support block 122 during punching operations.

The top die 108 and bottom die 110 are vertically aligned and fixedly attached to the top support plate 118, and the bottom support plate 120, respectively. The punch block 106 is fixedly attached to the shiftable support block 122, as well as the actuator 124 and the linear bearing slide 128, and is vertically aligned between the top die 108 and the bottom die 110. A plurality of fasteners A, or any other suitable attachment means, may be used to fixedly assembled the above-discussed components. Examples of suitable fasteners A may include shoulder bolts, cap head screws, quick release fasteners, and dowel pins. The physical configuration of the top die 108, the bottom die 110 and the movable punch block 106 therebetween, creates a top and bottom receiving cavity 134 and 136. The receiving cavities 134 and 136 are defined as the space between the top die 108 and the punch block 106, and the punch block 106 and the bottom die 110.

Figure 2:
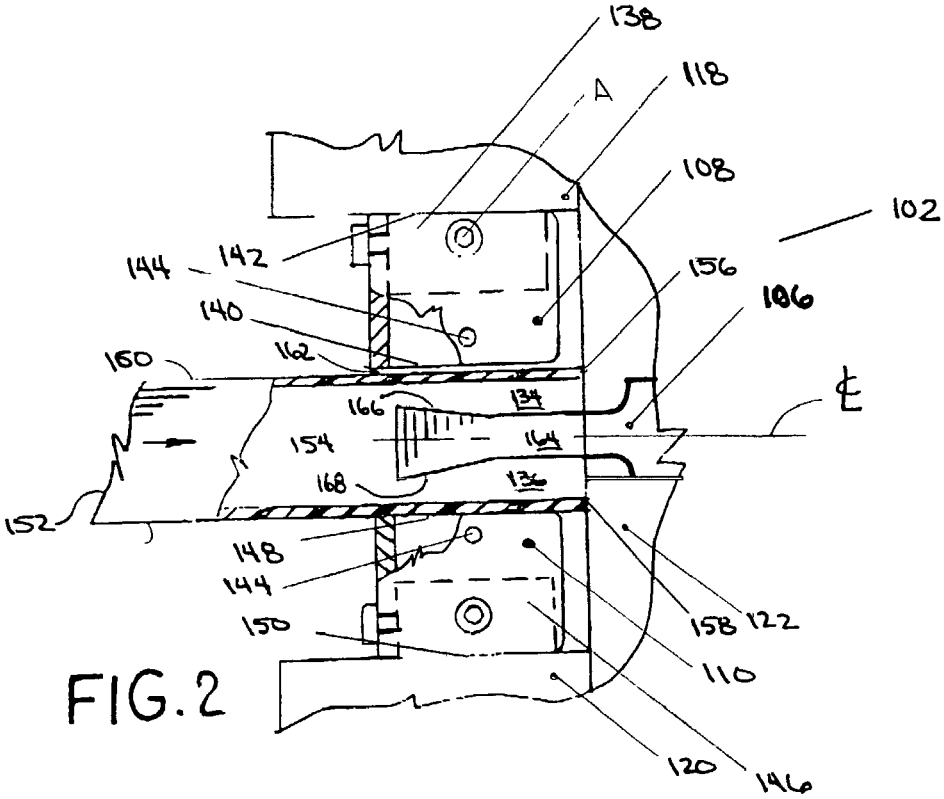
FIG. 2 is an enlarged side elevational view of the die set of the notching device illustrated in FIG. 1, and the workpiece prior to the beginning of the notching cycle.

FIG. 2 illustrates an enlarged view of the first die set 102 and the surrounding components when the actuator 124 is in the at-rest position. The top die 108 is fixedly attached to the top fixed support block 118 via an adaptor 138 and a fastener A. The top die 108 includes a first cutting surface 140 and a second cutting surface 142. The second cutting surface 142 may be placed into operation by removing fasteners A from the adaptor 138, inverting the top die 108 and reattaching the top die 108 to the adaptor 138 via a predrilled hole 144 and the fastener A. The bottom die 110 is fixedly attached to the bottom fixed support block 120 via an adaptor 146 and the fastener A. The bottom die 110 includes a first cutting surface 148 and a second cutting surface 150. The bottom die 110, similar to the top die 108, may be inverted by reorienting the die block and reattaching it using the predrilled hole 144 and the fastener A.

Figure 8:
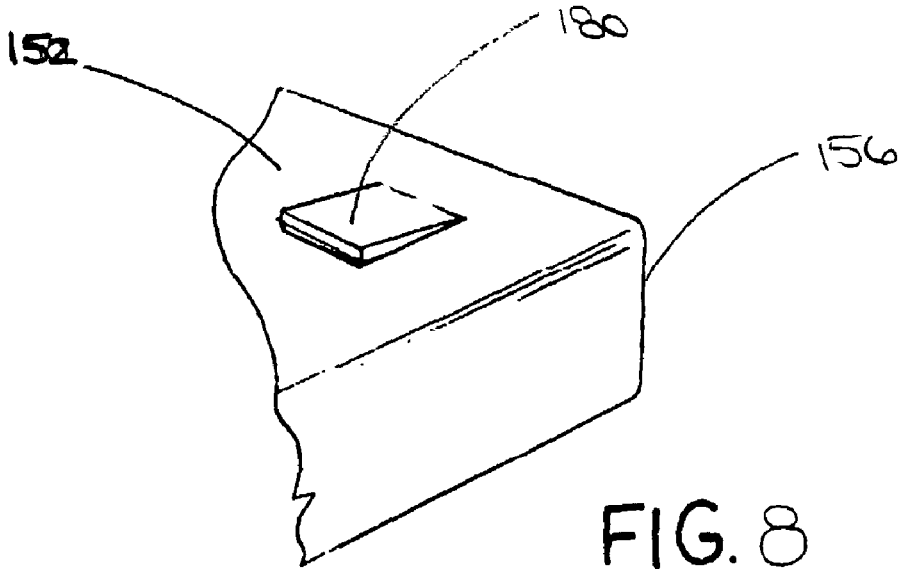
FIG. 8 is an enlarged fragmentary perspective view in of a notch formed in a hollow workpiece.

A workpiece 152 having an interior 154 is shown positioned within the receiving cavities 134 and 136. A first end 156 of the workpiece 152 is gauged or positioned against the shiftable support block 122, as indicated by the numeral 158. A gap 162 is shown separating the top surface of workpiece 152 and the top die 108, while the bottom surface of the workpiece 152 is firmly supported by the bottom die 110. The gap 162 is sized to allow the finished workpiece (as illustrated in FIG. 8) to be removed from the receiving cavities 134 and 136.

The punch block 106 includes a cantilevered punch 164 extending from the main body of the punch block 106 into the interior 154 of the workpiece 152, thereby positioning the punch 164 between the top die 108 and the bottom die 110. The punch 164 includes a first punching surface 166 that is angled upwards in the direction of the first die surface 140. The punch 164 further includes a second opposing punching surface 168 that is angled downwards in the direction of the second die surface 148. The relative angle of the punching surfaces 166 and 168 effectively magnifies the cutting force experienced by the workpiece 152 by reducing the contact area through which the force is transmitted. The reduced contact area, in effect, focuses the cutting force and allows the punch to "scissor" through the material, thereby increasing the overall efficiency of the notching device 100.

Figure 2A:
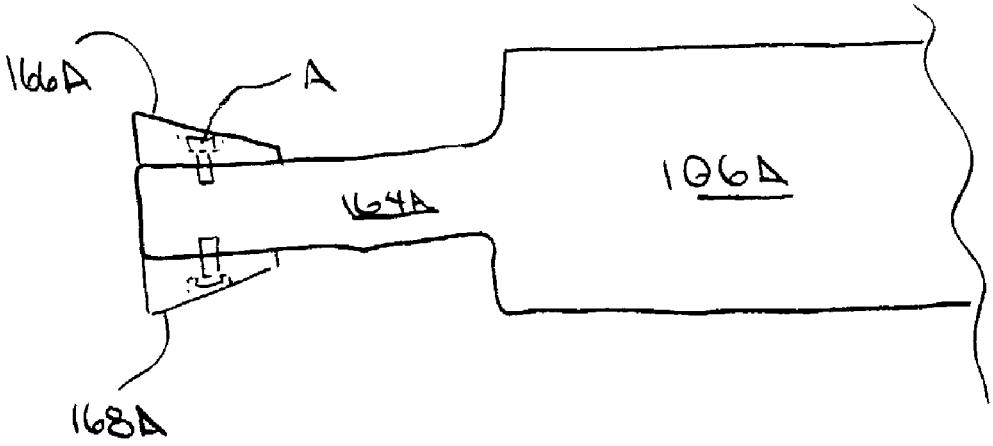
FIG. 2A is an enlarged side elevational view of another embodiment of the punch of the notching device illustrated in FIG. 1.

FIG. 2A illustrates an alternate embodiment of the punch block 106. A punch block 106A includes a punch 164A formed to accept a pair of removable cutting surfaces 166A and 168A. The removable cutting surfaces 166A and 168A are fixedly attached to the punch 164A using at least one fastener A. Moreover, the cutting surfaces 166A and 168A may be further positioned using a ground dowel pin or a specially formed pocket or step formed within the punch 164A. By forming the punch 164A in this manner, which is well known in the art, the precise location of the cutting surfaces 166A and 168A can be insured.

Figure 3:
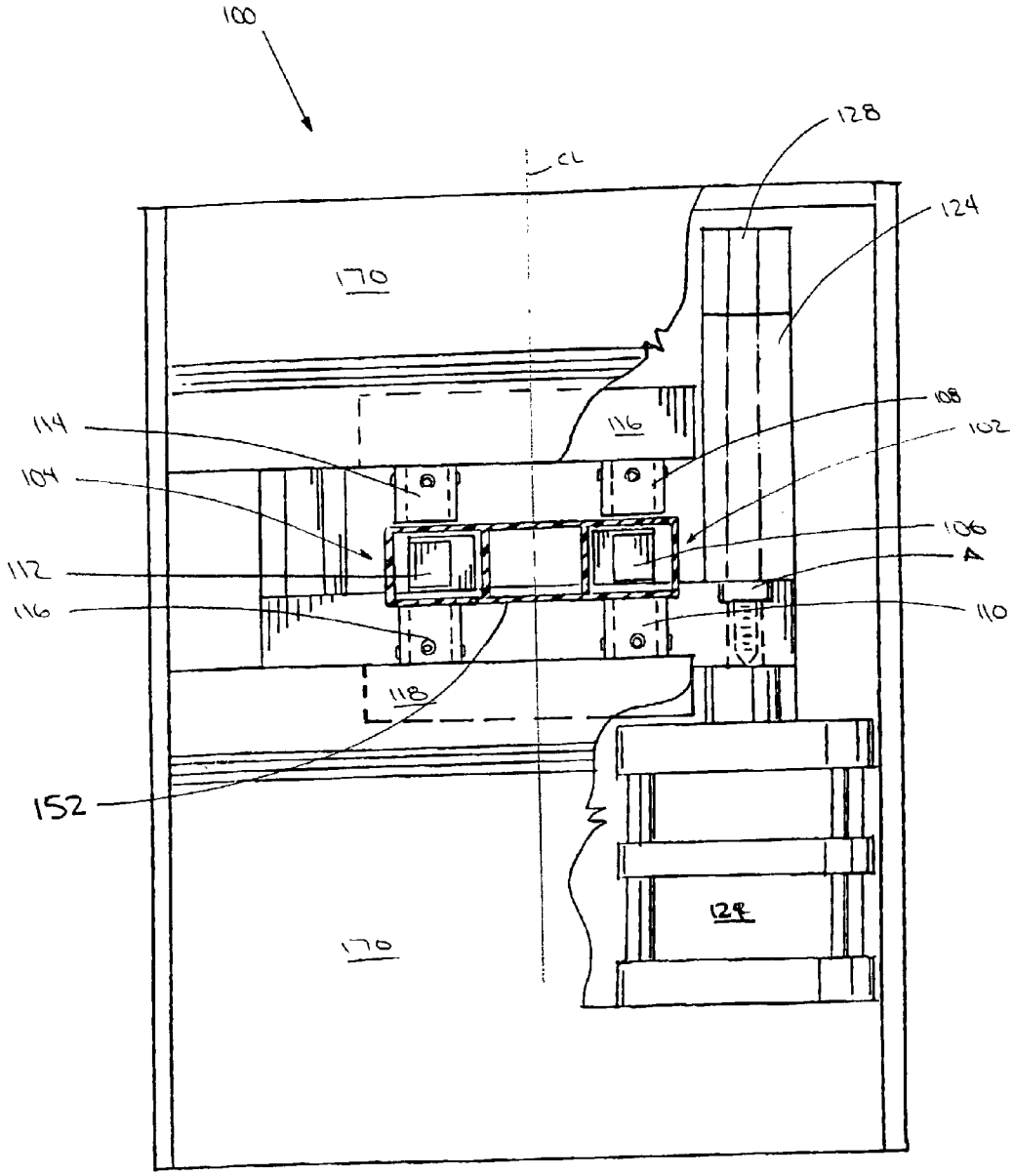
FIG. 3 is a front elevational view of the notching device illustrated in FIG. 1 showing the installed workpiece prior to the beginning of the notching cycle.

FIG. 3 illustrates a front view of the notching device 100 of FIG. 1 showing the workpiece 152 positioned within the receiving cavities 134 and 136, prior to the beginning of the notching cycle. The notching device 100 further includes a cover 170 designed to limit access to the individual components of the notching device 100. The cover 170 further provides a safety shield to guard against potential injuries and unwanted and potentially harmful material from entering and fouling the operation of the notching device 100.

As will be readily apparent to a person of ordinary skill in the art, the notching device 100 is generally symmetrical about a centerline CL. Moreover, the two-position die sets 102 and 104 are shown (in FIGS. 1 and 3) as mirror images of each other. For the sake of brevity and clarity, the symmetrical die set 102 has exclusively been described about the centerline CL (see FIG. 3). It will be understood that although the operation of the second two-position die 104 is identical, the physical configuration may or may not be the same as the first two-position die set 102, depending on the defined manufacturing requirements.

Figure 4:
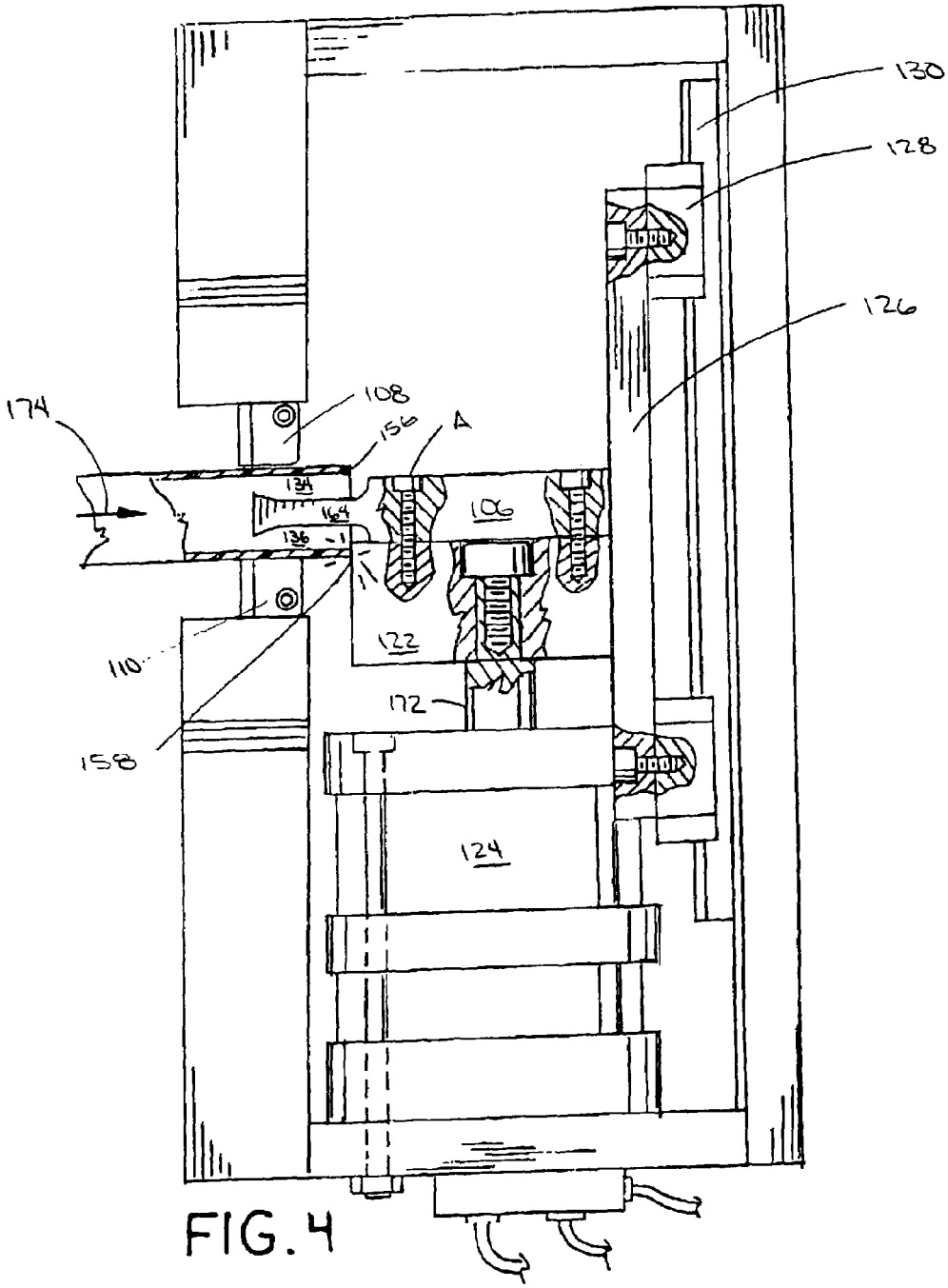
FIG. 4 is a side elevational view of the notching device illustrated in FIG. 1 with the workpiece installed.

FIGS. 4 to 7 illustrate the notching device 100 in discrete positions throughout one of the preferred embodiments of the notching cycle. FIG. 4 illustrates the notching device 100 in the at-rest position which is defined as the point at which an actuator rod 172 is in the neutral, or non-punching position. The workpiece 152 is inserted into the receiving cavities 134 and 136, in the direction indicated by the arrow 174. The first end 156 of the workpiece 152 is gauged by the shiftable support block 122 at the point 158, thereby properly positioning the workpiece within the notching device 100.

Figure 5:
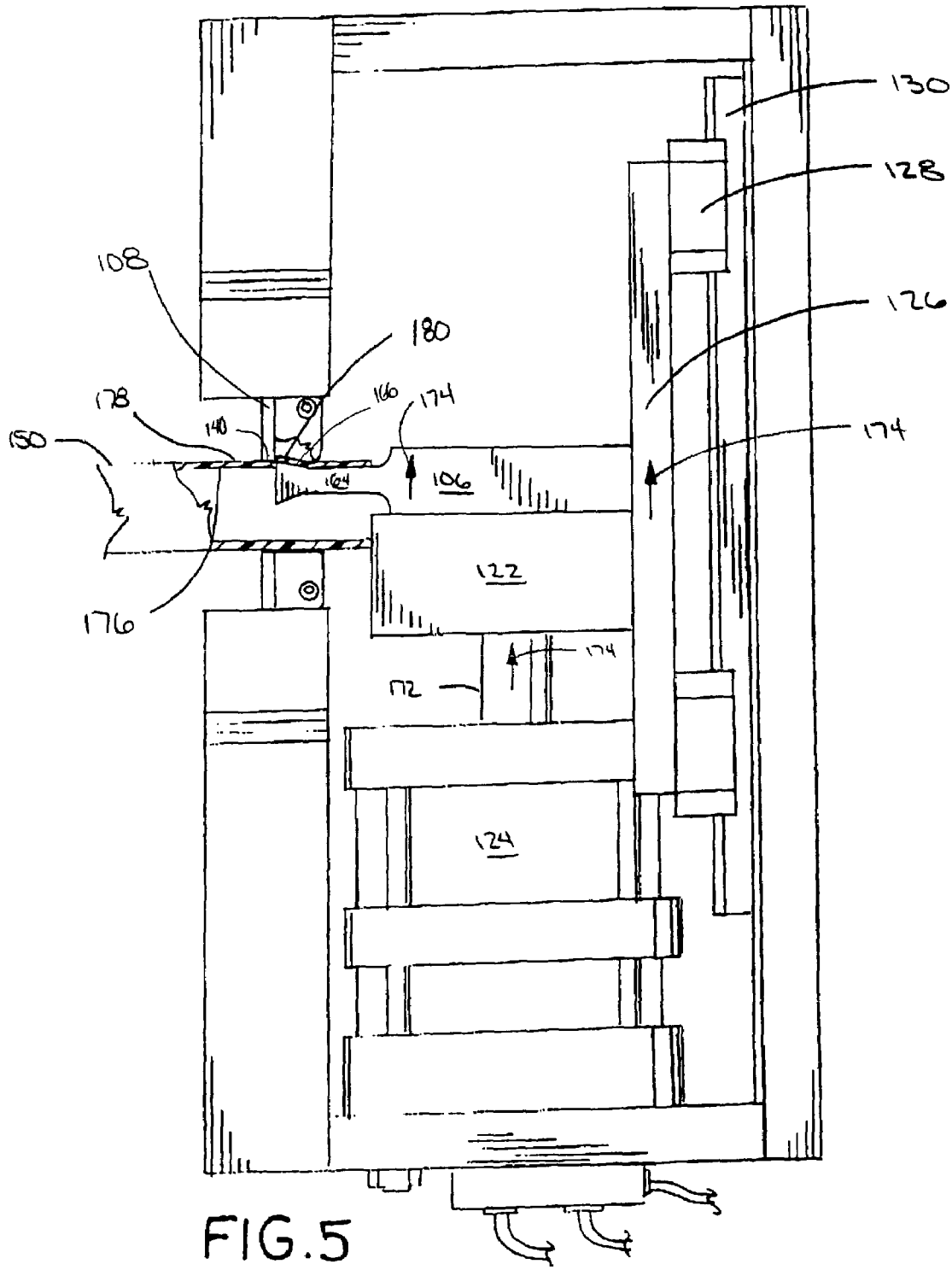
FIG. 5 is a side elevational view similar to FIG. 4 but showing the notching device in the first notching position.

FIG. 5 illustrates the notching device 100 in the top or first punching position. The notching device 100 shifts from the at-rest position (shown in FIG. 4) to the first punching position, in response to the extension of the actuator rod 172 in the direction indicated by the arrow 174. The actuator rod 172 may be fixedly attached to the shiftable support plate 122 by engaging the threaded end (not shown) of the actuator rod 172 and a complementary aperture formed into the shiftable support plate 122. The shiftable support plate 122, attached punching block 106, and cantilevered punch 164 respectively, are in turn sequentially, vertically guided by the coupling block 126 and linear slide bearing 128. The extension of the actuator rod 172 forces the punch 164 and the first punching surface 166 into contact with an interior surface 176 of the workpiece 152. The workpiece 152, the punch 164, and the first punching surface 166 shift upward until an external surface 178 of the workpiece 152 engages the first cutting surface 140 of the top die 108. At this point, the first punching surface 166 passes through a plane defined by the first cutting surface 140, thereby piercing the workpiece and forming an upper notch 180.

Figure 6:
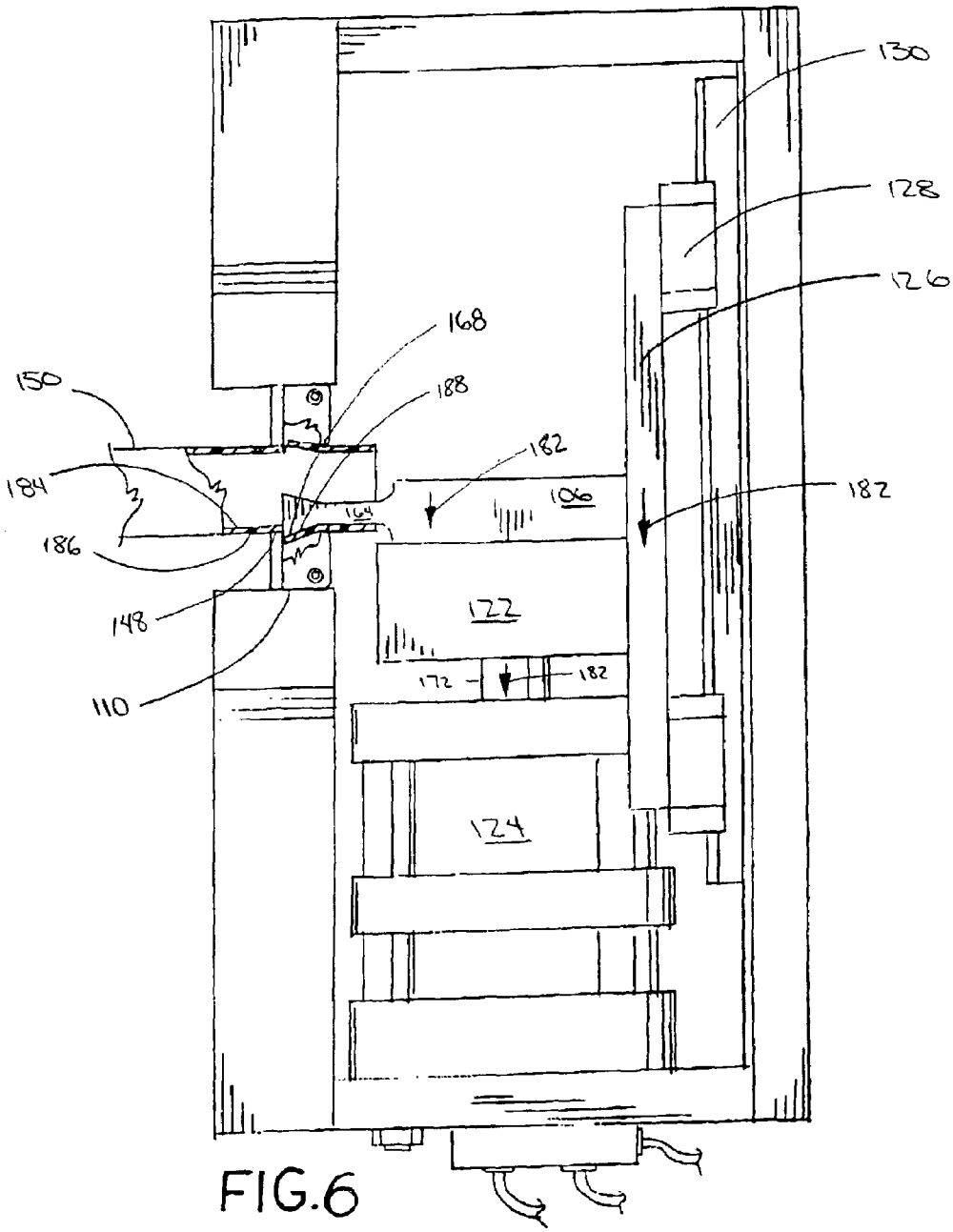
FIG. 6 is a side elevational view similar to FIGS. 4 and 5 but showing the notching device in the second notching position.

FIG. 6 illustrates the notching device 100 in the bottom or second punching position. The notching device 100 shifts downward from the first punching position (shown in FIG. 5) through the at-rest position (shown in FIG. 4), to the second punching position in response to the retraction of the actuator rod 172 in the direction indicated by the arrow 182. The retraction of the actuator rod 172, the attached slidable support plate 122 and punching block 106 forces the punch 164 and the second punching surface 168 into contact with an interior surface 184 of the workpiece 152. The workpiece 152, the punch 164, and the second punching surface 168 shift downward until an external surface 186 of the workpiece 152 engages the first cutting surface 148 of the bottom die 110. At this point, the second punching surface 168 passes through a plane defined by the first cutting surface 148, thereby piercing the workpiece and forming a bottom notch 188.

Figure 7:
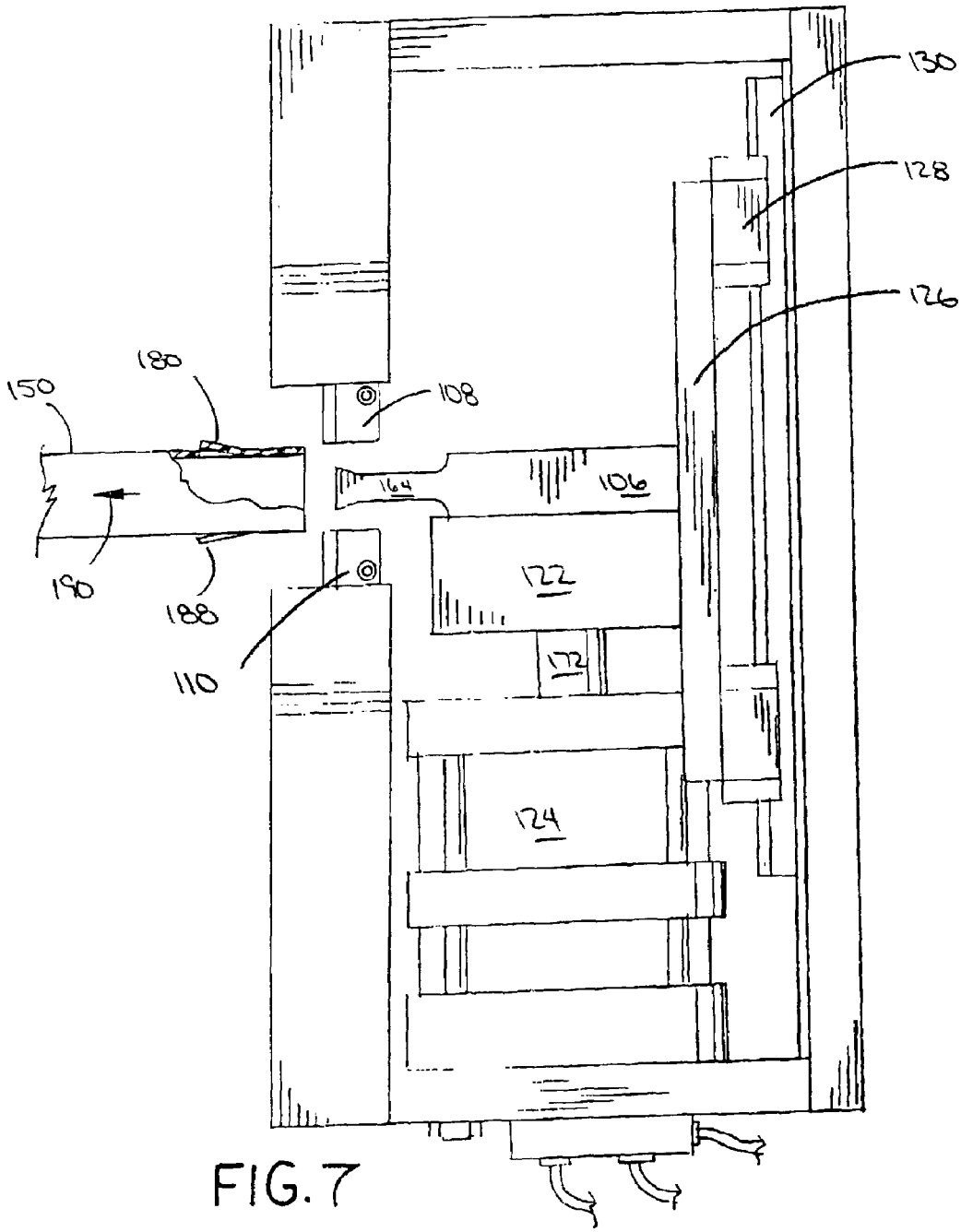
FIG. 7 is a side elevational view similar to FIGS. 4 through 6 but showing the completed workpiece being removed from the notching device.

FIG. 7 illustrates the notching device 100 in the at-rest position (similar to FIG. 4) at the completion of a notching cycle. The completed workpiece 152 having the upper notch 180 and the bottom notch 188 is removed from the receiving cavities 134 and 136, in the direction indicated by the arrow 190. It should be noted that the bottom notch 188 may be retained within the bottom die 110 thereby requiring the workpiece 152 to be rocked (laterally or vertically) to facilitate removal. The gap 162, as previously discussed, is sized to allow the finished workpiece to be removed from the receiving cavities 134 and 136.

Figure 9:
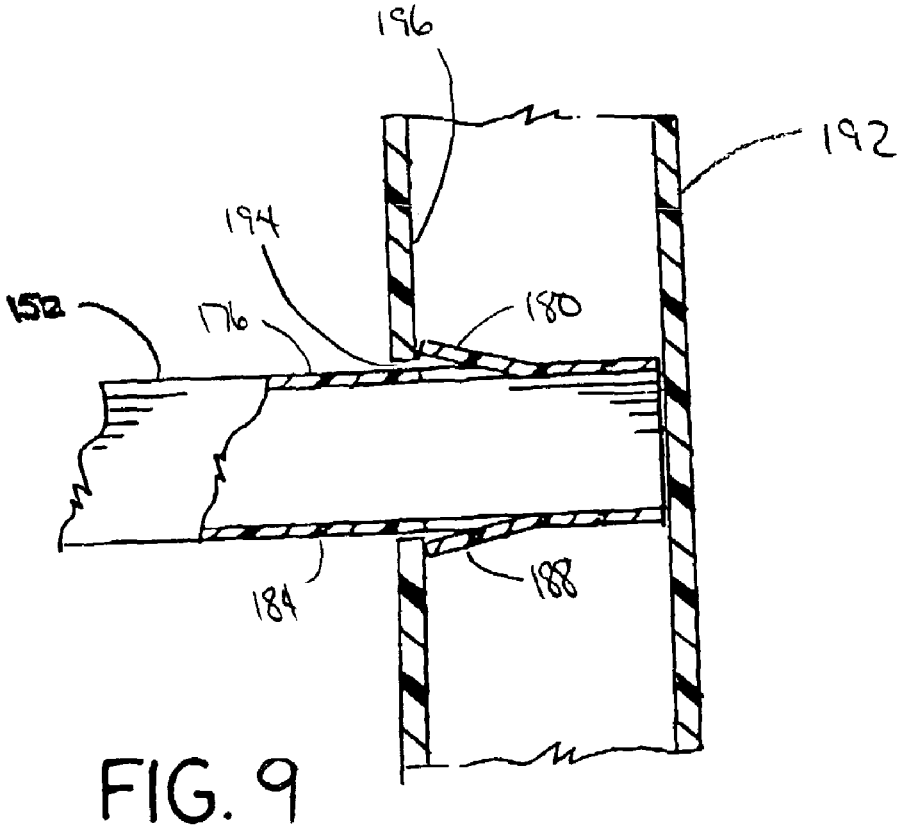
FIG. 9 is an enlarged fragmentary perspective view in of a notched workpiece engaging a hollow member.

FIGS. 8 and 9 illustrate a finished workpiece 152 external to the notching device 100, and an exemplary application of the workpiece 152 in operation. FIG. 8 illustrates a hollow workpiece 152 having a first end 156 and the upper notch 180 formed proximate to the first end 156. FIG. 9 illustrates the finished workpiece 152 engaged, for example, with a complementary fencing piece 192. The complementary fencing piece 192 includes a receiving aperture 194 sized to accept the first end 156, the upper notch 180 and the bottom notch 188 of the workpiece 152. Upon insertion of the first end 156 into the receiving aperture 194, the upper notch 180 and the lower notch 188 flex to positions contiguous with the external surfaces 178, 184 of the workpiece 152. Once clear of the receiving aperture 194, the notches 180 and 188 return to their original, notched positions and engage the inner surface 196 of the complementary fencing piece 192 to prevent removal of the workpiece 152.

Those skilled in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the appended claims either literally or under the doctrine of equivalents.

What is claimed is:

1. A device for consecutively forming one or more notches in a first surface and one or more notches in a second surface of a hollow workpiece, the device comprising:

a first die;

a second die, the second die fixed opposite the first die and aligned with the first die along a linear path; and a punch, the punch disposed between the first and second dies and having a first cutting surface and a second cutting surface, the punch shiftable along the linear path between a first punching position and a second punching position, the second punching position linearly opposite the first punching position, the first cutting surface and the first die cooperating to form a first notch when the punch proceeds towards the first punching position, the second cutting surface and the second die cooperating to form a second notch when the punch proceeds towards the second punching position.

2. The device of claim 1 wherein the first cutting surface and the second cutting surface include a removable cutting insert.

3. The device of claim 1 wherein the first die and the second die include a removable die insert.

4. The device of claim 1 wherein the punch is mounted to a movable actuator, and wherein the punch is sized for insertion between the first and second surfaces of the hollow workpiece.

5. The device of claim 4 wherein the punch and actuator are slideably mounted to a bearing slider.

6. The device of claim 4 wherein the movable actuator is a hydraulic cylinder, a pneumatic cylinder or a mechanical press.

7. The device of claim 4 wherein the movable actuator is a three-position actuator.

8. A device for consecutively forming one or more notches in a first surface and one or more notches in a second surface of a hollow workpiece, the device comprising:

a first die;

a second die, the second die fixed relative to the first die;

a punch, the punch having a first cutting surface and a second cutting surface, the punch shiftable along a linear path between a first punching position and a second punching position, the first cutting surface and the first die cooperating to form a first notch when the punch proceeds towards the first position, the second cutting surface and the second die cooperating to form a second notch when the punch proceeds towards a second position, the first and second punching positions spaced apart along the linear path;

a third die;

a fourth die, the fourth die fixed relative to the third die; and a second punch, the second punch having a third cutting surface and a fourth cutting surface, the second punch shiftable along a linear path between a first punching position and a second punching position, the first and second punching positions spaced apart along the linear path; and wherein the first cutting surface and the first die and the third cutting surface and the third die cooperate to simultaneously form a pair of notches in a first surface of the workpiece and the second cutting surface and the second die and the fourth cutting surface and the fourth die cooperate to simultaneously form a pair of notches in a second surface of the workpiece.

9. A notching apparatus for forming a first notch on a first surface and a second notch on a second surface of a hollow workpiece, the notching apparatus comprising:

an actuator, the actuator drivable between a first punching position and a second punching position;

only a single punch, the punch operatively coupled to the actuator and movable along a linear path in response to movement of the actuator between the first and second punching positions, the punch having a pair of linearly opposite cutting surfaces disposed in the linear path;

a first die positioned in the linear path and aligned with the first cutting surface; and a second die positioned in the linear path and aligned with the second cutting surface;

the first cutting surface cooperating with the first die to form the first notch in response to movement of the actuator along the linear path to the first punching position, the second cutting surface cooperating with the second die to form the second notch in response to the movement of the actuator along the linear path to the second punching position.

10. The notching apparatus of claim 9 including an actuator operatively coupled to the punch.

11. The notching apparatus of claim 9 wherein the actuator is a three position actuator.

12. The notching apparatus of claim 9 wherein the dies are fixedly mounted to a die set.

13. The notching apparatus of claim 9 wherein the first die and the second die are spaced apart along the linear path and arranged to fit within the hollow workpiece.

14. The notching apparatus of claim 9 wherein the punch includes a first and second removable working surface.

15. The notching apparatus of claim 9 wherein the first die and the second die are removably attached to a pair of die mounts.

16. The notching apparatus of claim 9 wherein the punch and the actuator are fixedly attached to at least one bearing slider.

17. The notching apparatus of claim 9 wherein the punch and the dies are manufactured from steel selected from the group consisting of composite powdered metal (CPM), S-series, A-series, O-series, and D-series tool steels.

18. A notching apparatus for forming a first notch on a first surface and a second notch on a second surface of a hollow workpiece, the notching apparatus comprising:

an actuator, the actuator drivable along a linear path between a first punching position and a second punching position;

a punch, the punch fixedly attached to the actuator and having a pair of opposing cutting surfaces, the pair of opposing cutting surfaces spaced apart in a direction parallel to the linear path;

a first die positioned opposite the first cutting surface;

a second die positioned opposite the second cutting surface;

the first cutting surface cooperating with the first die to form the first notch in response to movement of the actuator to the first punching position, the second cutting surface cooperating with the second die to form the second notch in response to the movement of the actuator to the second punching position;

a second punch, the second punch fixedly attached to the actuator and having a third and a fourth opposing cutting surfaces, the third and fourth cutting surfaces spaced apart in a direction parallel to the linear path;

a third die positioned opposite the third cutting surface; and a fourth die positioned opposite the fourth cutting surface;

wherein the first cutting surface cooperates with first die and the third cutting surface cooperates with the third die to simultaneously form a pair of notches in a first surface of the workpiece and the second cutting surface cooperates with second die and the fourth cutting surface cooperates with the fourth die to simultaneously form a pair of notches in a second surface of the workpiece.

19. A method for notching a first surface and a second surface of a hollow workpiece comprising:

providing a first die and a second die disposed toward opposite ends of a linear path;

providing an actuator shiftable between a first punching position and a second punching position;

providing a punch shiftable along the linear path in response to movement of the actuator between the first and second punching positions, the punch having a first cutting surface and a second cutting surface;

affixing the punch to the actuator;

aligning the first cutting surface of the punch relative to the first die and the second cutting surface of the punch relative to the second die;

shifting the first cutting surface of the punch in a first direction along the path from an at rest position to cooperate with the first die, and shifting the second cutting surface of the punch in a second direction along the path opposite the first direction from an at rest position to cooperate with the second die.

20. The method of claim 19 wherein the step of providing the first die and the second die removably attaching the first die and the second die with a plurality of attachment means.

21. The method of claim 19 wherein the step of providing the punch with the first cutting surface and the second cutting surface further includes removably attaching the first and second cutting surfaces with a plurality of attachment means.

22. The method of claim 19 wherein the step of providing the first die and the second die further includes the first die and the second die cooperating to form a receiving cavity sized to accept the workpiece when it is inserted around the punch.

23. A device for consecutively forming a first pair of notches in a first surface and a second pair of notches in a second surface of a hollow workpiece, the device comprising:

a first tool set including;

a first die and a second die, wherein the first die and the second die are fixed relative to each other;

a first punch having a first cutting surface and a second cutting surface, wherein the punch is shiftable along a straight linear path between a first punching position and a second punching position;

a second tool set including;

a third die and a fourth die, wherein the third die and the fourth die are fixed relative to each other;

a second punch having a third cutting surface and a fourth cutting surface, wherein the second punch is shiftable along a straight linear path between the first punching position and the second punching position;

wherein the first cutting surface and the first die and the third cutting surface and the third die are arranged to simultaneously form the first pair of notches in the first surface of the hollow workpiece in response to the movement of the first punch and the second punch to the first punching position; and wherein the second cutting surface and the second die and the fourth cutting surface and the fourth die cooperate to simultaneously form the second pair of notches in the second surface of the hollow workpiece in response to the movement of the first punch and the second punch to the second punching position.

24. A device for consecutively forming notches on a first surface and an opposing second surface of a workpiece, the first and second surfaces of the workpiece separated by a hollow cavity, the device comprising:

a punch shiftable along a linear path from a rest position in a first direction and a second direction opposite the first direction, the punch having a first cutting surface and a second cutting surface and sized to fit within the hollow cavity between the first and second surfaces;

a first die spaced away from the first cutting surface by a first gap when the punch is in the rest position;

a second die spaced away from the second cutting surface by a second gap when the punch is in the rest position;

the first and second gaps sized to permit placement of the workpiece in the device with the first surface disposed in the first gap at the same time the second surface is disposed in the second gap; and the first cutting surface and the first die arranged to form a notch in the first surface in response to moving the punch in the first direction, and the second die and the second cutting surface arranged to form a notch in the second surface in response to moving the punch to the second position.

25. A device for consecutively forming one or more notches in a first surface and one or more notches in a second opposing surface of a hollow workpiece, the device comprising:

a first die;

a second die, the second die fixed along a linear path opposite the first die; and a single punch, the single punch having a first cutting surface and an opposing second cutting surface, the single punch shiftable along the path between a first punching position and a second opposing punching position, the first cutting surface and the first die cooperating to form a first notch when the single punch proceeds towards the first position, the second opposing cutting surface and the second die cooperating to form a second notch when the punch proceeds towards a second position.

* * * * *